United States Patent [19]

Townsend

[11] 4,056,231

[45] Nov. 1, 1977

[54] SCRAP TREATMENT

[75] Inventor: Nicholas A. Townsend, Bexley, England

[73] Assignee: British Steel Corporation, London, England

[21] Appl. No.: 711,076

[22] Filed: Aug. 2, 1976

[30] Foreign Application Priority Data

Aug. 7, 1975 United Kingdom ..... 33079/75

[51] Int. Cl.[2] ..... B02C 23/06

[52] U.S. Cl. ..... 241/23; 241/DIG. 37; 241/DIG. 38; 62/52; 62/54

[58] Field of Search ..... 241/23, DIG. 37, DIG. 38; 62/51, 52, 54

[56] References Cited

U.S. PATENT DOCUMENTS

| | | | |
|---|---|---|---|
| 3,058,315 | 10/1962 | Schuftan | 62/52 |
| 3,319,434 | 5/1967 | Matesanz | 62/54 |
| 3,661,542 | 5/1972 | Collins | 62/54 |
| 3,666,185 | 5/1972 | Williams | 241/DIG. 37 |
| 3,760,597 | 9/1973 | Becker | 62/52 |
| 3,804,339 | 4/1974 | Laws et al. | 241/DIG. 37 |
| 3,818,976 | 6/1974 | Ledergerber | 241/DIG. 37 |

*Primary Examiner*—Granville Y. Custer, Jr.
*Attorney, Agent, or Firm*—Bacon & Thomas

[57] ABSTRACT

A process for treating metal scrap includes cooling the scrap until it is brittle by contacting it with a first cooling agent which is gaseous and then fragmenting the scrap, said first cooling agent being cooled by being passed through a heat exchanger to which a second cooling agent is fed partly in the liquid phase and partly in the gaseous phase and from which the second cooling agent emerges in the gaseous phase, said second cooling agent being supplied to the heat exchanger partly from a liquid storage facility and partly directly from a refrigeration plant, the refrigeration plant being used in conjunction with a liquifier to supply the storage facility with liquid second cooling agent.

14 Claims, 4 Drawing Figures

SCRAP TREATMENT

Figure 1:
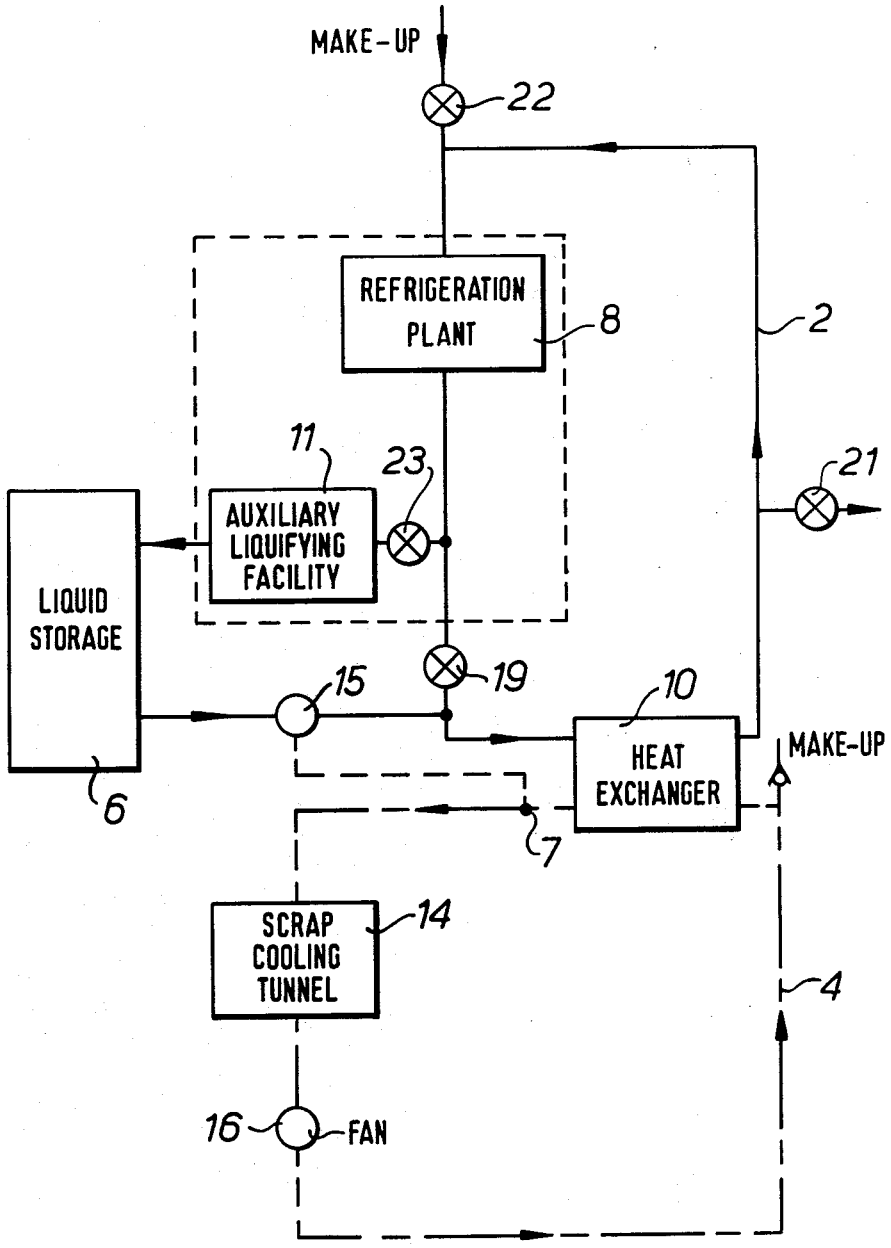

This invention relates to the treatment of scrap. In particular, it relates to improvements or modifications of the invention described and claimed in our U.S. Pat. No. 3,804,339.

According to one aspect of the present invention, a process for treating metal scrap includes cooling the scrap until it is brittle by contacting it with a first cooling agent which is gaseous and then fragmenting the scrap, said first cooling agent being cooled by being passed through a heat exchanger to which a second cooling agent is fed partly in the liquid phase and partly in the gaseous phase and from which the second cooling agent emerges in the gaseous phase, said second cooling agent being supplied to the heat exchanger partly from a liquid storage facility and partly directly from a refrigeration plant, the refrigeration plant being used in conjunction with a liquifier to supply the storage facility with liquid second cooling agent. The storage facility may be supplied with liquid second cooling agent only during interruptions in the process of cooling the scrap. The supply of liquid second cooling agent from the storage facility to the heat exchanger is primarily aimed at supplementing the cooling load supplied by the refrigeration plant which is preferably run continuously at constant load, and may be further controlled in response to any unevenness in the cooling demand of the scrap being treated. The cooling demand may be determined by measuring the temperature of the first cooling agent entering and/or leaving the heat exchanger.

The gaseous second cooling agent is supplied to the refrigeration plant following its emergence from the heat exchanger. During periods in which the cooling of the scrap is interrupted, the refrigeration plant preferably draws 'warm' gas (e.g. air, nitrogen or natural gas) from an external source and in conjunction with the liquifying plant replenishes the liquid store in readiness for the next scrap cooling cycle.

The scrap may be pressed into rectilinear bundles before being contacted by the first cooling agent. After the bundle has been cooled, it may then be fragmented by applying forces to the bundle at locations on opposite sides of the bundle spaced along the length of the bundle, the locations at one side being offset with respect to the locations at the other side or by any other means of applying high impact loads (e.g. hammer mills).

The scrap may be passed continuously in bundles through a chamber continuously fed with the first cooling agent, the first cooling agent emerging from the chamber being fed back to the heat exchanger to be cooled again. Preferably, the scrap is fed through the chamber in one direction and the first cooling agent flows through the chamber in the opposite direction. The scrap may be carried on a conveyor which is pervious to the movement of gas, the chamber being provided with baffles to direct the first cooling agent through the conveyor from the upper side of the conveyor to the lower side and back again.

The first cooling agent may be nitrogen or alternatively air. The second cooling agent may be nitrogen or air or alternatively it may be a methane-containing fluid (e.g. natural gas) or any other suitable refrigerant.

Figure 2:
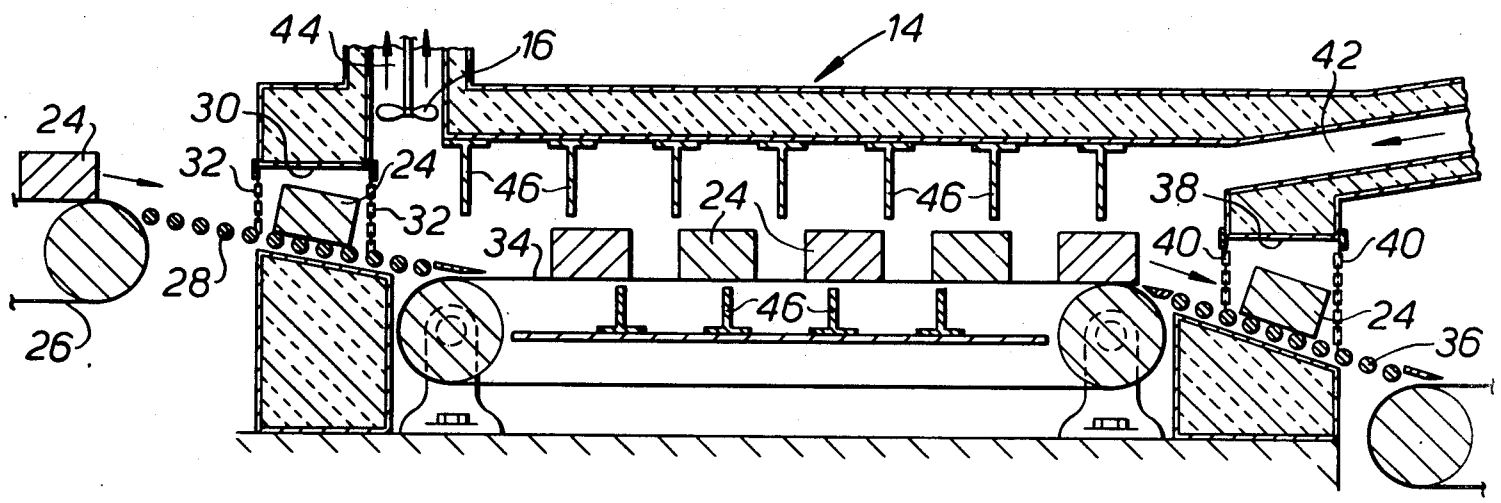
Figure 3:
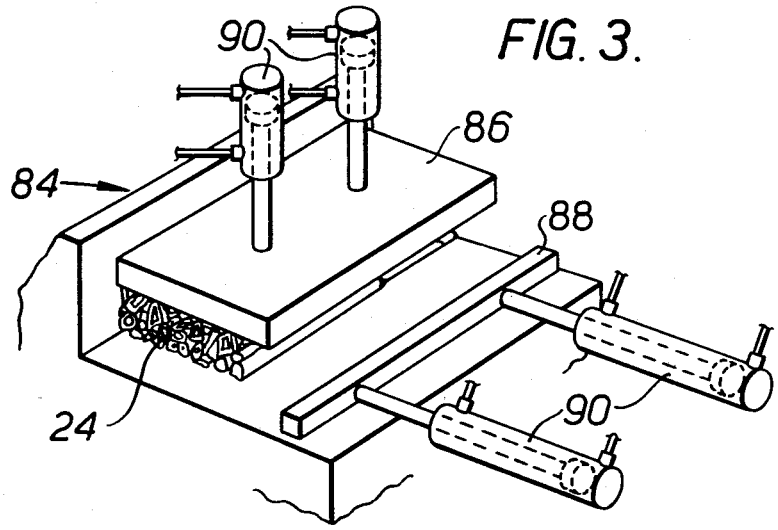
Figure 4:
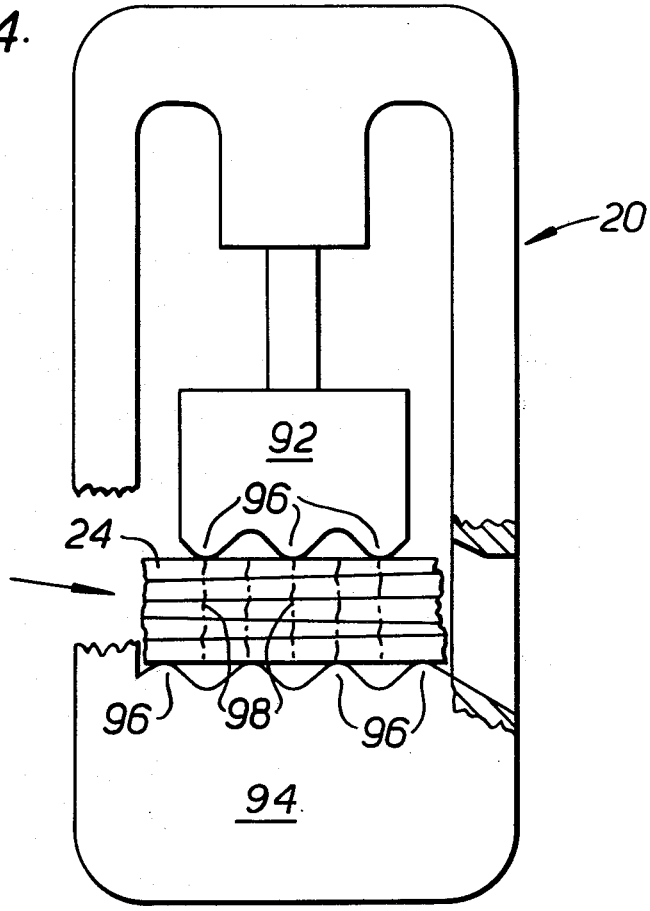

An embodiment of the invention will now be described by way of example only, with reference to the accompanying drawings in which:

FIG. 1 shows schematically part of a scrap treatment process according to the invention, FIG. 2 is a cross-sectional side view of part of the arrangement shown in FIG. 1, and FIGS. 3 and 4 show schematically further details of the apparatus for use with that shown in FIG. 2.

The apparatus of FIG. 1 comprises two loops, a primary loop 2 and a secondary loop 4. Both loops pass through a heat exchanger 10 where the nitrogen gas in the secondary loop 4 is cooled.

The fluid in the primary loop 2 is also nitrogen. Nitrogen gas leaving the heat exchanger 10 is lowered in temperature in a refrigeration plant 8. The refrigerated gas is then passed either directly to the heat exchanger 10 together with liquid bled from a cryogenic storage tank 6, or alternatively it is fed through a liquifier 11 to the cryogenic storage tank 6. Valve 19 in the primary loop 2 and valve 23 in the line to the liquifier 11 are operable to determine whether the refrigerated gas is passed to the storage tank 6 or directly to the heat exchanger 10 or whether the refrigerated gas is passed to both the liquifier 11 as well as heat exchanger 10. Liquid cryogen entering the heat exchanger 10 from the store is vaporised in the heat exchanger, and together with the gas leaving the refrigeration plant 8 is superheated thereby cooling the gaseous nitrogen in the secondary loop 4 which also passes through the heat exchanger 10.

In the secondary loop 4 gaseous nitrogen cooled in the heat exchanger 10 is continuously fed to a tunnel 14 to cool the scrap by direct contact with the scrap as shown more fully in FIG. 2. The nitrogen emerging from the tunnel 14 is driven by a fan 16.

Cooled scrap emerging from the tunnel 14 is crushed in a crushing plant 20 (shown in FIG. 4) and the fragmented scrap is then subjected to a magnetic separation process to remove non-ferrous materials. After being allowed to warm to ambient temperature the ferrous scrap can be charged into a steelmaking vessel.

In one mode of operation, all the gas leaving the refrigeration plant 8 passes directly to the heat exchanger 10, but in periods when the scrap cooling tunnel 14 is not in use, the refrigerated gas passes to the auxiliary liquifier 11, in which all of it is liquified and is then directed to the storage tank 6, the refrigeration plant 8 being kept in operation all the time. The extra nitrogen required by the refrigeration plant 8 when the valve 19 is shut is supplied through a make-up valve 22 from external sources. The liquid cryogen from storage tank 6 is then used when the tunnel 14 is in use to supplement the refrigerated gas which comes directly from the refrigeration plant 8.

In another mode of operation part of the gas leaving the refrigeration plant 8 passes directly to heat exchanger 10, the other part passing to the liquifier 11. The proportion of refrigerated gas passed to the liquifier 11 is controlled by valves 19 and 23.

The amount of liquid drawn from storage tank 6 to supplement the cooling effect of the refrigerated gas is determined by the desire to keep the refrigeration plant 8 working continuously at constant load. With a regular production cycle for scrap cooling the normal operating schedule would be as follows.

During the planned daily shut-down of the cooling tunnel 14 the refrigeration plant 8 plus auxiliary liquifier 11 takes from an external source gaseous refrigerant (e.g. nitrogen), at roughly atmospheric temperature and converts it to its liquid phase, by opening valve 22 and 23, and closing valves 19 and 21. On the following day, during the scrap cooling phase of the production cycle the make up source of 'warm' gas is isolated from the primary loop by closing valve 22. Then liquid nitrogen is drawn from the storage tank 6 with valve 15 open, to supplement the refrigerated nitrogen that continuously circulates around the primary loop 2. For continuity of mass flow in the primary loop 2 the amount of liquid drawn from the storage tank 6 and then vaporised in the heat exchanger must be rejected from the primary loop 2 (e.g. by return to make-up source or dumped to atmosphere), and this is done by opening valve 21.

With this principle of operation the refrigeration plant 8 is run continuously at constant — and maximum — load. Thus the rated capacity, and hence cost, of the refrigeration plant 8 is minimised.

In addition to the above benefits, it is well known that refrigeration plant run continuously is more reliable than if it is run intermittently.

The provision of a standby liquid storage tank 6 also has the benefit of being able to respond rapidly and easily to changes in the scrap cooling load. This is done by sensing the temperature of the gas in the secondary loop by means of a sensor 7 either before and/or after the heat exchanger, and from this signal adjusting the rate liquid is drawn from the store by control of valve 15. This ability to quickly and substantially boost the cooling rate facilitates rapid start-up of the secondary loop from 'warm' conditions after a long shut down period.

FIG. 2 shows the scrap cooling tunnel 14 in cross section. Bundles of scrap 24 are delivered by a conveyor 26 to an inclined roller table 28 which passes through the entry 30 of the tunnel 14. The entry 30 is provided with chain screens 32 to form an air lock. The roller table 28 delivers the bundle onto a conveyor 34, and thence through the tunnel to an inclined roller table 36 passing through an exit air lock 38 also provided with chain screens 40. At the bundle exit end of the tunnel there is an inlet 42 for cooled nitrogen gas and at the bundle entry end there is an outlet 44 for nitrogen provided with the fan 16. The tunnel 14 is provided with baffles 46 above and below the upper run of the conveyor 34 with the upper baffles 46 being offset with respect to the lower baffles 46. Scrap can therefore be fed through the tunnel continuously in one sense and cooled nitrogen can flow through the tunnel in the opposite sense. The baffles 46 direct the cooled gas through the conveyor 34 from one side to the other and back again to promote exchange of heat between the scrap and the nitrogen. As the bundles 24 pass through the tunnel 14 they are cooled continuously and quickly.

FIG. 3 shows a press 84 for lightly compressing loose scrap to bind it into compact bundles 24 before being contacted by the cooled nitrogen. The press 84 includes two pressing members 86 and 88 operated by hydraulic rams 90. The member 86 squeezes the pieces to the required width. The bundles 24 need not have a density as high as those leaving a conventional balling process, but for certain materials (e.g. tin cans) the density should be as high as possible.

FIG. 4 shows a crusher 20 which is similar in construction to a forging hammer except that it has 'saw toothed' plattens 92, 94. The plattens 92, 94 have projections 96 which contact the cooled bundle 24 at locations spaced along the length of the bundle, the projections 96 on one platten being offset with respect to the projections on the other platten. The projections 96 impart highly localised bending moments and shear forces to the scrap and thus promote fracture at preferred planes indicated by chain dot lines 98. The bundles 24 leaving the cooling tunnel 14 are fed intermittently through the crusher 20. There are practical considerations which limit the minimum pitch of the projection 96 and hence the particle size that can be obtained from the crusher 20. Further crushing is therefore necessary to achieve a smaller particle size. In the case of plain carbon steels it is possible to use a conventional inpacting machine, such as a hammer mill of the type used for crushing minerals, immediately after crushing in the primary crusher 20.

However low alloy steels, which are more resistant to impact than carbon steels, are best first subject to thermal shock so as to cause surface crazing or cracking. The scrap is particularly susceptible to thermal shock because of its brittleness and poor conductivity at low temperatures. The crazing and cracking causes stress raisers in the scrap which promote fracture in a secondary crusher.

Plain carbon steel is ductile at temperatures above about 0° C and is very brittle below −30° C. In between there is a narrow transition region. Low alloy steels have a large transition region and in general need to be cooled to a lower temperature than plain carbon steels to render them brittle. It is to be understood that in the performance of the process of the invention the metal to be crushed should preferably be cooled so as to be in the brittle region, although the process may be used with some of the metal at a temperture in the transition region.

I claim:

1. A process for fragmenting metal scrap includes cooling the scrap until it is brittle by contacting it with a first cooling agent which is gaseous and then fragmenting the scrap in its brittle state, said first cooling agent being cooled by being passed through a heat exchanger to which a second cooling agent is fed partly in the liquid phase and partly in the gaseous phase and from which the second cooling agent emerges in the gaseous phase, in which the improvement resides in said cooling agent being supplied to the heat exchanger partly from a liquid storage facility and partly directly from a refrigeration plant, the refrigeration plant being used in conjunction with a liquifier to supply the storage facility with liquid second cooling agent, and in which the gaseous second cooling agent is supplied to the refrigeration plant following its emergence from the heat exchanger said refrigeration plant, during periods in which the cooling of the scrap is interrupted, drawing warm gas from an external source and, in conjunction with the liquifying plant, replenishing the liquid store in readiness for the next scrap cooling cycle.

2. A process as claimed in claim 1 in which the storage facility is supplied with liquid second cooling agent only during interruptions in the process of cooling the scrap.

3. A process as claimed in claim 1 in which the refrigeration plant is run continuously at constant load.

4. A process as claimed in claim 1 in which the supply of second liquid cooling agent from the storage facility to the heat exchanger is further controlled in response to any unevenness in the cooling demand of the scrap being treated.

5. A process as claimed in claim 4 in which the cooling demand is determined by measuring the temperature of the first cooling agent.

6. A process as claimed in claim 1 in which the scrap is presed into rectilinear bundles before being contacted by the first cooling agent.

7. A process as claimed in claim 1 in which after the bundle has been cooled, it is then fragmented by applying forces to the bundle at locations on opposite sides of the bundle spaced along the length of the bundle, the locations at one side being offset with respect to the locations at the other side.

8. A process as claim in claim 1 in which after the bundle has been cooled it is then fragmented by applying high impact loads.

9. A process as claimed in claim 1 in which the scrap is passed continuously in bundles through a chamber continuously fed with the first cooling agent, the first cooling agent emerging from the chamber being fed back to the heat exchanger to be cooled again.

10. A process as claimed in claim 9 in which the scrap is fed through the chamber in one direction and the first cooling agent flows through the chamber in the opposite direction.

11. A process as claimed in claim 9 in which the scrap is passed through the chamber on a conveyor, the chamber being provided with baffles to direct the first cooling agent through the conveyor from the upper side of the conveyor to the lower side and back again.

12. A process as claimed in claim 1 in which the first cooling agent is nitrogen.

13. A process as claimed in claim 1 in which the second cooling agent is nitrogen.

14. A process as claimed in claim 1 in which the second cooling agent is a methane-containing fluid.

* * * * *